United States Patent [19]

Beckmann et al.

[11] Patent Number: 4,772,360

[45] Date of Patent: Sep. 20, 1988

[54] THIN WALL COKE QUENCHING CONTAINER

[75] Inventors: Reinhold Beckmann; Gerhard Friebe; Klaus Genter, all of Duisburg; Guenter Hof, Muelheim; Gerhard Winzer, Duisburg, all of Fed. Rep. of Germany

[73] Assignee: Mannesmann AG, Duesseldorf, Fed. Rep. of Germany

[21] Appl. No.: 16,555

[22] Filed: Feb. 19, 1987

[30] Foreign Application Priority Data

Feb. 21, 1986 [DE] Fed. Rep. of Germany ..... 3606071

[51] Int. Cl.[4] ..... C10B 39/14

[52] U.S. Cl. ..... 202/227; 202/229; 202/230

[58] Field of Search ..... 202/227, 229, 230; 105/254; 110/171; 201/39

[56] References Cited

U.S. PATENT DOCUMENTS

| | | | |
|---|---|---|---|
| 425,797 | 4/1890 | Hunt | 202/227 |
| 469,867 | 3/1892 | Osbourn | 202/227 |
| 469,868 | 3/1892 | Osbourn | 202/227 |
| 4,312,711 | 1/1982 | Brown et al. | 202/227 |

FOREIGN PATENT DOCUMENTS 3344828 4/1985 Fed. Rep. of Germany .

*Primary Examiner*—Barry S. Richman
*Assistant Examiner*—Joye L. Woodward
*Attorney, Agent, or Firm*—Ralf H. Siegemund

[57] ABSTRACT

A twin wall coke quenching container having an upwardly slanting bottom, there being a first plurality of quenching water inlets in an upper portion of that bottom, the openings of the first plurality having axes transverse to the upwardly slanting bottom; a second plurality of water inlet openings are disposed in front and rear walls not much higher than a level of that edge and being arranged only in the bottom portion having the first plurality of openings; a third plurality of water inlet openings extend along the upper edge, and axial inclination similar to said slant of the bottom.

1 Claim, 3 Drawing Sheets

THIN WALL COKE QUENCHING CONTAINER

BACKGROUND OF THE INVENTION

The present invention relates to a twin wall or double wall container for quenching or extinguishing of coke having an inclined bottom, a coke and water inlet in the lowest part of the container and feeder pipes for quenching water being connected to suitable conduits for running the quenching water through the walls of that container.

A coke quenching carriage or car with a container is known for example through German patent No. 33 44 828. This kind of carriage container is also useful for quenching of coke through dipping or immersion with simultaneous or subsequent further quenching by means of spraying water onto the coke. This kind of an arrangement is of advantage for treating large quantities of coke with little detriment to the ecology and environment on account of any contaminating vapors or the like.

DESCRIPTION OF THE INVENTION

It is an object of the present invention to improve such simple point coke extinguishing and quenching carriage container, particularly with regard to lowering the amount and quantity of moisture contained in the completed coke and to further obtain a more uniform quenching process.

In accordance with the preferred embodiment of the present invention it is suggested to restrict the quenching water inlets in the container bottom to a portion of the bottom which extends from a central plane of the carriage. The bottom slants upwardly from one container wall to the opposite wall; the axes of the water inlets opening are at 90 degress to that slanted container bottom; additional water inlet openings are included in portions of the front and rear walls to a level not higher than about the upper edge of the upwardly slanted bottom. In addition, the portion of the side wall which extends directly along that upper edge of the container bottom is provided with further water inlet openings having an axis which is inclined with and follows the slant of the contaienr bottom. Generally speaking the volume of the container should be at least 40 to 100% larger than the amount of coke to be filled in.

BRIEF DESCRIPTION OF THE DRAWINGS

While the specification concludes with claims particularly pointing out and distinctly claiming the subject matter which is regarded as the invention, it is believed that the invention, the objects and features of the invention, and further objects, features and advantages thereof will be better understood from the following description taken in connection with the accompanying drawings in which:

DESCRIPTION OF THE PREFERRED EMBODIMENT

Figure 1:
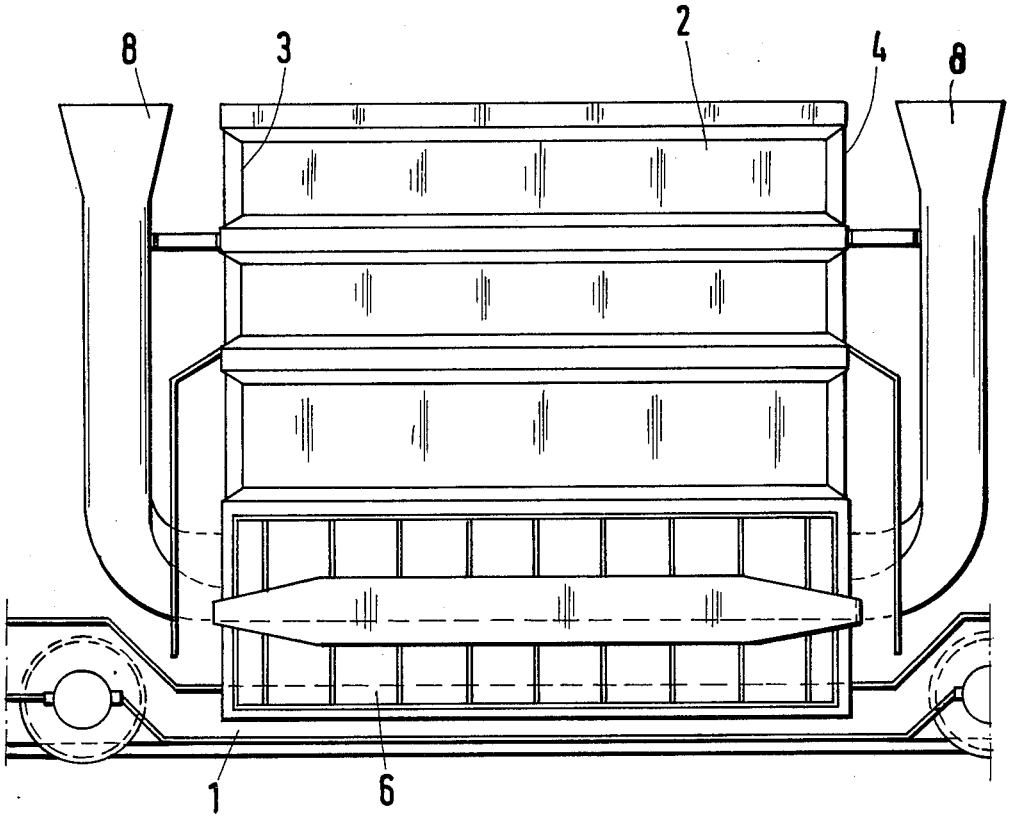
FIG. 1 is a side view of a double wall coke quenching container mounted on a car or carriage in accordance with the preferred embodiment of the invention.
Figure 2:
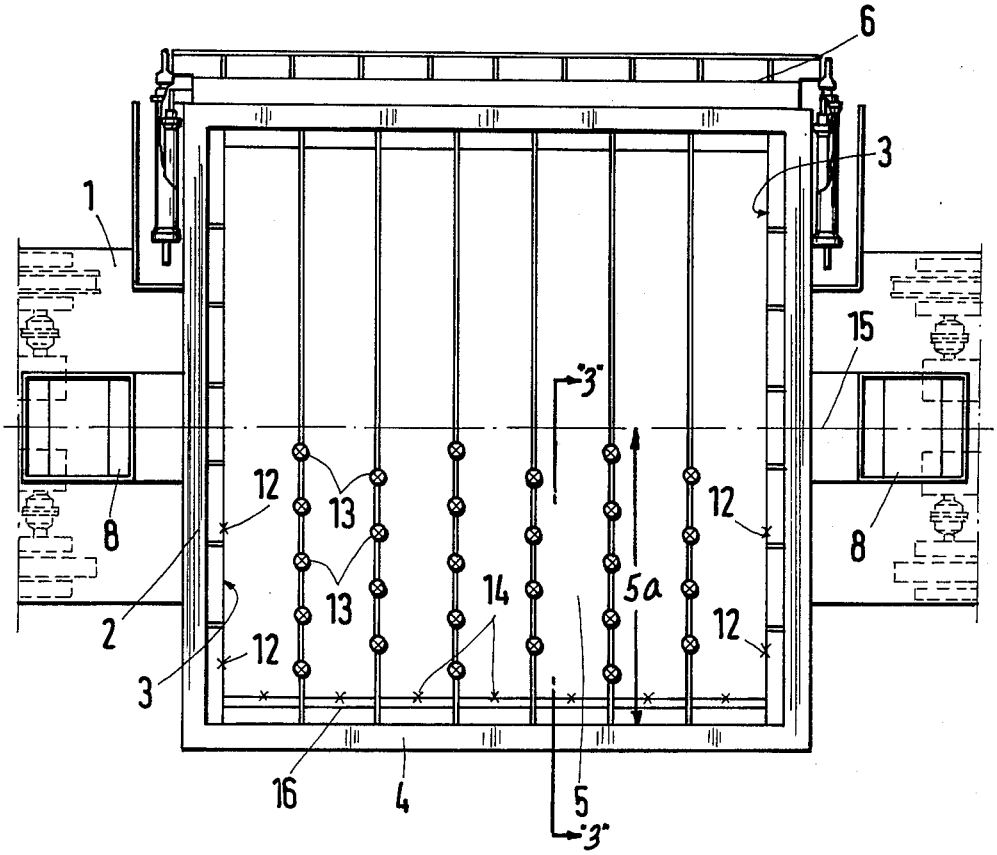
FIG. 2 is a top elevation of the container shown in FIG. 1.

Proceeding to the detailed description of the drawings, FIG. 1 illustrates a carriage with a dropped or flat bottom upon which is mounted a double wall or twin wall container 2 provided for quenching or extinguishing hot coke. The inner wall of this container 2 are established by wearing plates 3 being basically components of the walls 4 as well as the bottom 5. An opening for the discharge of the water as well as coke is closed by means of flap 6 which is to be opened from the outside. In addition, a grid or griddle 7 is provided in that discharge opening. The griddle-flap arrangement 7, 6 is situated in one side wall, next to the lowest point (or line) of an upwardly slanting bottom 5.

Generally speaking the quenching water for immersion and spray quenching is fed to this container 2 through tubes 8 from which a branching system including tubes 9,10 and 11 manifolds and leads towards three pluralities of water charge openings 12, 13, and 14.

After this general description we refer to details of the water inlet openings 12–14 in the container bottom 5. As can readiley be seen these openings do not cover the entire bottom but only a portion thereof denoted by 5*a* and extending from a center plane 15 of the container to one of the walls. As stated, the entire bottom slants upwardly. The openings 13 are arranged in lines and have opening planes which have axes extending at 90 degrees to that slanted container bottom 5. It is advisable to provide some kind of baffle plate in front of the openings 13 in order to protect the water inlet openings so that coke and grit should not fall into the openings.

Figure 3:
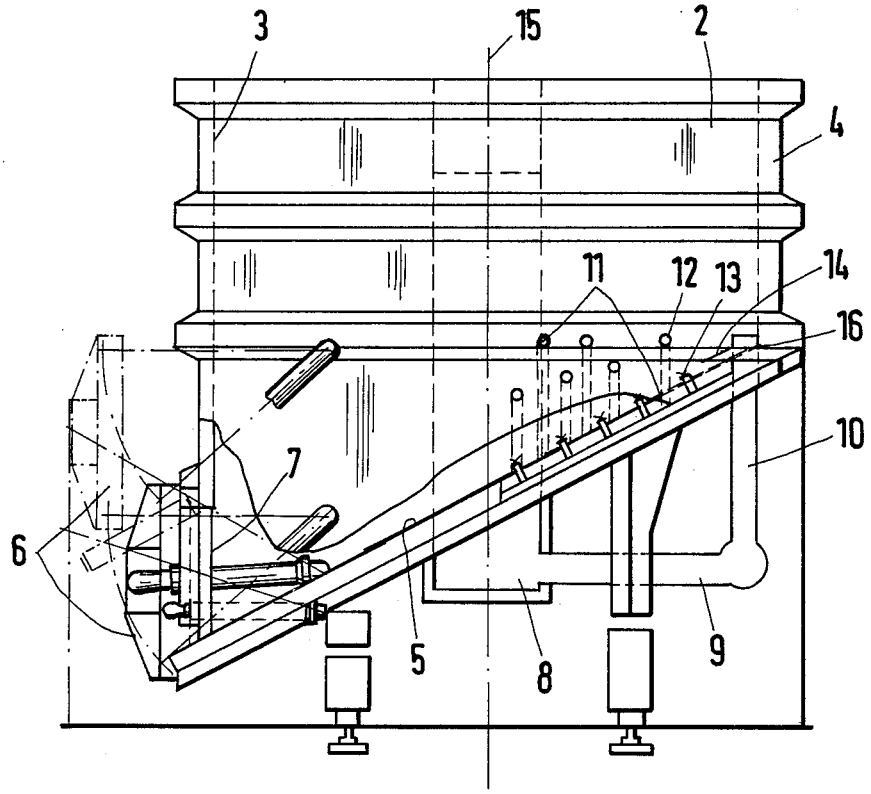
FIG. 3 is a section view as indicated by lines "3"—"3" in FIG. 2.

In accordance with the further feature of the present invention, the second plurality of water inlet openings 12 are provided in a certain portions of the front and rear walls of the container, particularly that portion of each wall abounding the bottom portion 5*a* in a lateral fashion. As stated, that portion 5*a* of the bottom which includes the openings 13 slants upwardly from the center plane 15 of the container towards a side wall 4. The openings 12 are provided in front and rear walls particularly adjacent to the bottom near portion as can be seen for example in FIG. 3.

The openings 12 in the front and rear wall of the container extend approximately to the level of the upper edge 16 of the highest portion of the bottom 5 adjacent one side wall 4. The axes of these openings 12 extend at right angles to the front and rear container walls.

The third plurality of openings 14 for spraying water into the container are disposed directly in the vicinity of and along the upper edge 16 of the container bottom portion 5*a*. The axes of these openings 14 are inclined corresponding to the inclination and slant of the bottom 5.

The one point quenching carriage and container configured and improved in accordance with the various features of the invention outlined above can be used in all kinds of sizes of coke chambers. Particular advantage flows from the use of a range of coke furnaces having a chamber capacity which per brand accomodates about 20 metric tons and above of coke. The capacity of the container should be selected to be at least about 40% larger than the volume of coke to be accomodated but should normally not be more than twice of that amount. However, the upper limit may be exceeded depending on geometric factors. In each case, however, the size of the container should be dimensioned so that any movement of the coke during quenching is confined to the interior of the container.

A laterally limited water supply, particularly during immersion and sudden inflow of water, provides on one hand a development of steam while on the other hand the level of the poured coke is equalized so that for coverage with water particularly with spraying of water a more or less planar surface of the poured coke obtains. This is a considerable advantage with regard to uniformity of cooling and wetting of the coke throughout.

Upon using a container constructed in accordance with the invention it was found that on processing of 43 metric tons coke per furnace chamber with a container cross section of 6×6 meters the following result obtains. Upon using a water quantity for immersion quenching of about 1.5 $m^3$/ton coke quenching was completed within 30 seconds. Following the quenching the coke had a moisture content of about 2%; there were no dry areas nor excessive local accumulation of moisture.

The invention is not limited to the embodiments described above, but all changes and modifications thereof, not constituting departures from the spirit and scope of the invention, are intended to be included.

We claim:

1. In a twin wall coke quenching container having an upwardly slanting bottom extending laterally from one side wall towards an opposite side wall and forming an upper edge with and along the opposite side wall, the container further having front and rear walls, and a feeder supply means for feeding quenching water to the container, the improvement comprising:

a first plurality of quenching water inlet openings in an upper portion of said upwardly slanting bottom of said container, lower portion of the upwardly slanting bottom being free from such openings, said openings of the first plurality of quenching water inlet openings having axes transverse to said upwardly slanting bottom;

a second plurality of water inlet openings in said front and rear walls in a limited portion in each instance, the respective limited portion extending substantially to a level of said edge and being arranged in portions of said front and rear walls only and adjacent to said upper portion of said bottom having the first plurality of openings;

a third plurality of water inlet openings in said opposite side wall, the latter openings being arranged along said upper edge, immediately adjacent to said container bottom and having an axial inclination that is equal to or at least similar to said slant of said bottom; and conduit means connected to the pluralities of openings and to said feeder supply means for feeding quenching water to all of said openings of said first, second and third plurality of water inlet openings.

* * * * *